US009111486B2

(12) United States Patent
Choi

(10) Patent No.: US 9,111,486 B2
(45) **Date of Patent: *Aug. 18, 2015**

(54) ORGANIC LIGHT EMITTING DISPLAY DEVICE

(75) Inventor: Sang-Moo Choi, Yongin (KR)

(73) Assignee: Samsung Display Co., Ltd., Yongin-si (KR)

( * ) Notice: Subject to any disclaimer, the term of this patent is extended or adjusted under 35 U.S.C. 154(b) by 330 days.

This patent is subject to a terminal disclaimer.

(21) Appl. No.: 12/969,484

(22) Filed: Dec. 15, 2010

(65) Prior Publication Data

US 2011/0273429 A1 Nov. 10, 2011

(30) Foreign Application Priority Data

May 10, 2010 (KR) ..... 10-2010-0043506

(51) Int. Cl.
*G09G 3/32* (2006.01)

(52) U.S. Cl.
CPC ..... *G09G 3/3225* (2013.01); *G09G 2300/0465* (2013.01); *G09G 2300/0861* (2013.01); *G09G 2320/0233* (2013.01)
USPC ..... 345/82; 345/211; 315/169.3

(58) Field of Classification Search
CPC ..... G09G 3/30–3/3291; G09G 2330/02; G09G 2300/0439–2300/0465; G09G 2300/08; G09G 2300/0842; H01L 27/124; H01L 27/3244; H01L 27/3276
USPC ..... 345/76–83, 204, 690; 315/169.3
See application file for complete search history.

(56) References Cited

U.S. PATENT DOCUMENTS

| | | | | |
|---|---|---|---|---|
| 7,057,588 | B2 * | 6/2006 | Asano et al. | 345/76 |
| 7,355,459 | B2 * | 4/2008 | Miyazawa | 327/112 |
| 2004/0095338 | A1 * | 5/2004 | Miyazawa | 345/204 |
| 2004/0239661 | A1 * | 12/2004 | Jo | 345/204 |
| 2005/0017934 | A1 | 1/2005 | Chung et al. | |

(Continued)

FOREIGN PATENT DOCUMENTS

| | | |
|---|---|---|
| KR | 10-2005-0090861 | 9/2005 |
| KR | 10-2006-0078427 | 7/2006 |

(Continued)

OTHER PUBLICATIONS

KIPO Office action dated Nov. 22, 2011, for Korean priority Patent application 10-2010-0043506, noting listed references in this IDS, 1 page.

(Continued)

*Primary Examiner* — Stephen Sherman
(74) *Attorney, Agent, or Firm* — Christie, Parker & Hale, LLP

(57) ABSTRACT

An organic light emitting display device includes: a scan driver; a data driver; a display unit including pixels located at crossing regions of scan lines and data lines; first power lines coupled between a first power supply and the pixels; at least one second power line located outside the display unit and coupled to a second power supply having a voltage different from a voltage of the first power supply; at least one third power line coupled to a third power supply having a voltage different from the voltage of the first power supply; and fourth power lines coupled to the pixels, wherein the pixels are charged with voltages corresponding to the data signals and the third power supply and are configured to control the amount of current flowing from the first power supply in response to the voltages charges in the pixels.

14 Claims, 4 Drawing Sheets

(56) References Cited

U.S. PATENT DOCUMENTS

| | | | | |
|---|---|---|---|---|
| 2005/0110730 | A1* | 5/2005 | Kim et al. | 345/82 |
| 2006/0044235 | A1 | 3/2006 | Lee et al. | |
| 2006/0077138 | A1 | 4/2006 | Kim | |
| 2006/0103611 | A1* | 5/2006 | Choi | 345/82 |
| 2006/0248420 | A1 | 11/2006 | Jeong | |
| 2006/0290617 | A1 | 12/2006 | Miyawawa | |
| 2007/0040772 | A1 | 2/2007 | Kim | |
| 2008/0142827 | A1 | 6/2008 | Choi et al. | |
| 2008/0143704 | A1 | 6/2008 | Choi | |
| 2008/0150846 | A1 | 6/2008 | Chung | |
| 2010/0007651 | A1 | 1/2010 | Kim | |
| 2010/0128014 | A1 | 5/2010 | Choi | |
| 2010/0188391 | A1 | 7/2010 | Kim | |
| 2012/0038683 | A1 | 2/2012 | Park et al. | |

FOREIGN PATENT DOCUMENTS

| | | | |
|---|---|---|---|
| KR | 10-2006-0135749 | | 12/2006 |
| KR | 10-0815756 | B1 | 1/2008 |
| KR | 10-2008-0060967 | | 7/2008 |
| KR | 10-0846969 | | 7/2008 |
| KR | 10-2008-0084017 | | 9/2008 |
| KR | 10-0873078 | B1 | 12/2008 |
| KR | 10-2009-0042714 | | 4/2009 |
| KR | 10-2009-0096893 | | 9/2009 |
| KR | 10-2005-00056 46 | | 1/2014 |

OTHER PUBLICATIONS

Korean Patent Abstracts, Publication No. 10-2008-0091926, dated Oct. 15, 2008, corresponding to Korean Patent 10-0873078, listed above.

U.S. Office action dated Apr. 11, 2013, for cross reference U.S. Appl. No. 12/846,678, (35 pages).

U.S. Office action dated Feb. 5, 2014, for cross reference U.S. Appl. No. 12/846,678, (15 pages).

KIPO Office action dated Mar. 26, 2012, for Korean Patent application 10-2010-0023762, (1 page).

English machine translation of Korean Patent 10-0719663 B1, dated May 11, 2007, (16 pages).

U.S. Notice of Allowance dated Jun. 9, 2014, for cross reference U.S. Appl. No. 12/846,678, (15 pages).

U.S. Notice of Allowance dated Oct. 6, 2014, for cross reference U.S. Appl. No. 12/846,678, (10 pages).

* cited by examiner

ORGANIC LIGHT EMITTING DISPLAY DEVICE

CROSS-REFERENCE TO RELATED APPLICATIONS

This application claims priority to and the benefit of Korean Patent Application No. 10-2010-0043506, filed on May 10, 2010, in the Korean Intellectual Property Office, the entire content of which is incorporated herein by reference.

BACKGROUND

1. Field

Aspects of embodiments according to the present invention relate to an organic light emitting display device, particularly an organic light emitting display device that can display an image with a desired luminance.

2. Discussion of Related Art

Recently, a variety of flat panel displays having reduced weight and volume relative to cathode electrode ray tubes, have been developed. Typical flat panel displays include a liquid crystal display, a field emission display, a plasma display panel, and an organic light emitting display device.

Organic light emitting display devices display an image, using organic light emitting diodes that produce light by recombining electrons and holes. The organic light emitting display devices have the advantages of a high response speed and are driven by low power. Conventional organic light emitting display devices allow organic light emitting diodes to generate light by supplying current, corresponding to a data signal, to the organic light emitting diodes by using driving transistors formed in pixels.

For this configuration, the pixels each include a storage capacitor for storing a voltage corresponding to the data signal. The storage capacitor charges a voltage corresponding to a data signal supplied to a data line and supplies the voltage to a driving transistor. Therefore, in order to display an image with desired gradation, it is required to accurately charge the storage capacitor with a voltage corresponding to the data signal.

However, for existing organic light emitting display devices, it is difficult to accurately charge the storage capacitors to the desired voltage level. To be more specific, a data signal is supplied to the storage capacitor through a data line. In this operation, a parasitic capacitor is in the data line, such that the data signal supplied to the data line is supplied to the storage capacitor while charging the parasitic capacitor. In this case, the storage capacitor is not accurately charged with the voltage corresponding to a desired data signal due to charge-sharing between the parasitic capacitor and the storage capacitor. In particular, even though the organic light emitting display device intends to display black, gray gradation is implemented, and accordingly the display quality is deteriorated.

SUMMARY

An aspect of an embodiment of the present invention provides an organic light emitting display device that can display an image with desired luminance.

Another aspect of an embodiment of the present invention is to provide an organic light emitting display device that makes it possible to reduce the manufacturing cost by forming a MOS (Metal Oxide Semiconductor).

Furthermore, according to an aspect of an embodiment of the present invention, it is possible to charge a storage capacitor with a desired voltage, using a second power supply unrelated to a first power supply that supplies current to the organic light emitting diode.

According to an embodiment of the present invention, there is provided an organic light emitting display device which includes:

BRIEF DESCRIPTION OF THE DRAWINGS

The accompanying drawings, together with the specification, illustrate exemplary embodiments of the present invention, and, together with the description, serve to explain the principles of the present invention, in which.

DETAILED DESCRIPTION

Figure 1:
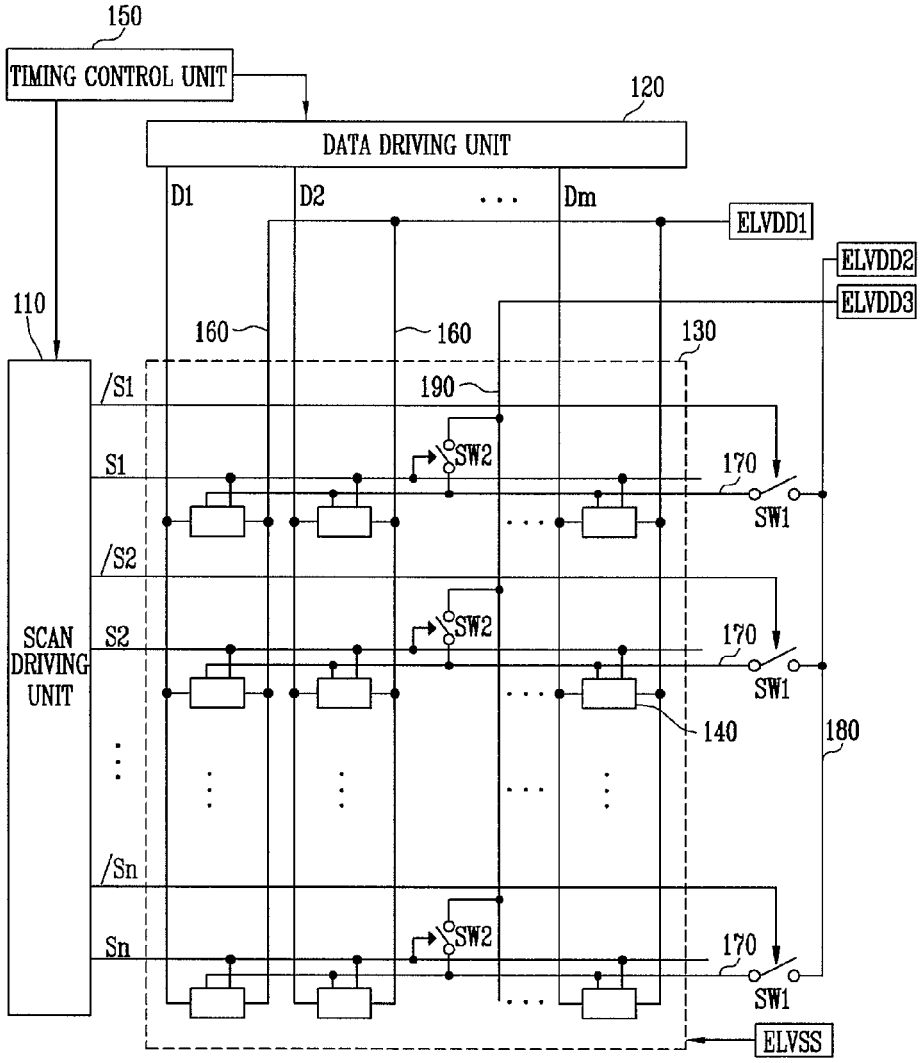
FIG. 1 is a diagram illustrating an organic light emitting display device according to an embodiment of the present invention.

Hereinafter, certain exemplary embodiments according to the present invention will be described with reference to the accompanying drawings. Here, when a first element is described as being coupled to a second element, the first element may be directly coupled to the second element or may be indirectly coupled to the second element via a third element. Further, some of the elements that are not essential to a complete understanding of the invention are omitted for clarity. Also, like reference numerals refer to like elements throughout.

Exemplary embodiments are described in detail with reference to FIGS. 1 to 6.

FIG. 1 is a diagram illustrating an organic light emitting display device according to an embodiment of the present invention.

Referring to FIG. 1, an organic light emitting display device according to a first embodiment of the present invention includes: a display unit 130 including pixels 140 located at the crossing regions of first scan lines S1 to Sn and data lines D1 to Dm; a scan driving unit (or a scan driver) 110 that drives the scan lines S1 to Sn and second scan lines /S1 to /Sn; a data driving unit (or a data driver) 120 that drives the data lines D1 to Dm; and a timing control unit 150 that controls the scan driving unit 110 and the data driving unit 120.

Further, the organic light emitting display device according to an embodiment of the present invention further includes: first power lines 160 extending in parallel with the data lines D1 to Dm in a first direction (e.g., a vertical direction) and coupled to the pixels 140; fourth power lines 170 (e.g., horizontal power lines) extending in parallel with the scan lines S1 to Sn in a second direction (e.g., a horizontal direction) and coupled to the pixels 140; a second power line 180 coupled to a second power supply ELVDD2 at the outside of the display unit 130; a third power line 190 extending in parallel with the data line Dm inside the display unit 130 and coupled to a third power supply ELVDD3; first switching elements SW1 coupled between the fourth power lines 170 and the second power line 180, and second switching elements SW2 coupled between the fourth power lines 170 and the third power line 190.

The scan driving unit 110 sequentially supplies scan signals to the first scan lines S1 to Sn and sequentially supplies inverse scan signals to the second scan lines /S1 to /Sn. The scan signals are set to a voltage level (e.g. low level) sufficient to turn on transistors included in the pixels 140. The inverse scan signals are set to a voltage level that can turn off the transistors by inverting the polarity of the scan signals, e.g., by using an inverter, etc.

For example, an inverse scan signal supplied to the i-th second scan signal /Si can be created by inverting the scan signal supplied to the i-th first scan line Si. For example, an inverse scan signal supplied to the i-th second scan signal /Si is set to supply the same (or substantially the same) timing and the same width (e.g., pulse width or duration) as the scan signal supplied to the i-th first scan signal Si, but with the polarity inverted.

The data driving unit 120 may supply the data signals to the data lines D1 to Dm when the scan signals are supplied.

The timing control unit 150 controls the scan driving unit 110 and the data driving unit 120. Further, the timing control unit 150 may rearrange the data supplied from the outside and transmit the data to the data driving unit 120.

The first power lines 160 are coupled to the pixels 140 in each of the vertical lines (e.g., columns). The first power lines 160 are coupled to the first power supply ELVDD1 and supply the voltage of the first power supply ELVDD1 to the pixels 140. The first power supply ELVDD1 supplies current (e.g., a predetermined current) to the organic light emitting diodes in the pixels 140.

The second power line 180 is outside of the display unit 130 and is coupled to the second power supply ELVDD2. The second power supply ELVDD2 is a power supply that controls gate electrode voltage of the driving transistors in the pixels 140 after a storage capacitor is charged, and has a low voltage.

At least one or more third power lines 190 are inside the display unit 130 and are coupled to the third power supply. The third power supply ELVDD3 is a power supply that controls the voltage provided to the charged capacitor Cst, and has a voltage level lower than that of the second power supply ELVDD2.

The fourth power lines 170 are coupled to the pixels in each horizontal line. The horizontal lines 170 are supplied with power from the second power supply ELVDD2 when the first switching elements SW1 are turned on, and supplied with power from the third power supply ELVDD3 when the second switching elements SW2 are turned on. For this operation, the first switching elements SW1 and the second switching elements SW2 are alternately turned on and off.

The first switching element SW is coupled between each of the fourth power lines 170 and the second power line 180. The switching elements SW1 are turned off when an inverse scan signal is supplied, and are turned on during the other period.

The second switching element SW is coupled between each of the fourth power lines 170 and the third power lines 190. The second switching elements SW2 are turned on when a scan signal is supplied, and electrically couple the fourth power lines 170 with the third power lines 190.

The display unit 130 includes the pixels 140 positioned at the crossing regions of the scan lines S1 to Sn and the data lines D1 to Dm. The storage capacitors in the pixels 140 are charged with a voltage corresponding to the voltage level difference between the data signal and the third power supply ELVDD3. In this configuration, the storage capacitor is charged with a voltage corresponding to the data signal and the third power supply ELVDD3 and control gate electrode voltage of a driving transistor in response to the voltage of the second power supply ELVDD2. The driving transistor controls the amount of current flowing from the first power supply ELVDD1 to a fourth power supply ELVSS through the organic light emitting diode in response to voltage applied to the gate electrode thereof.

Figure 2:
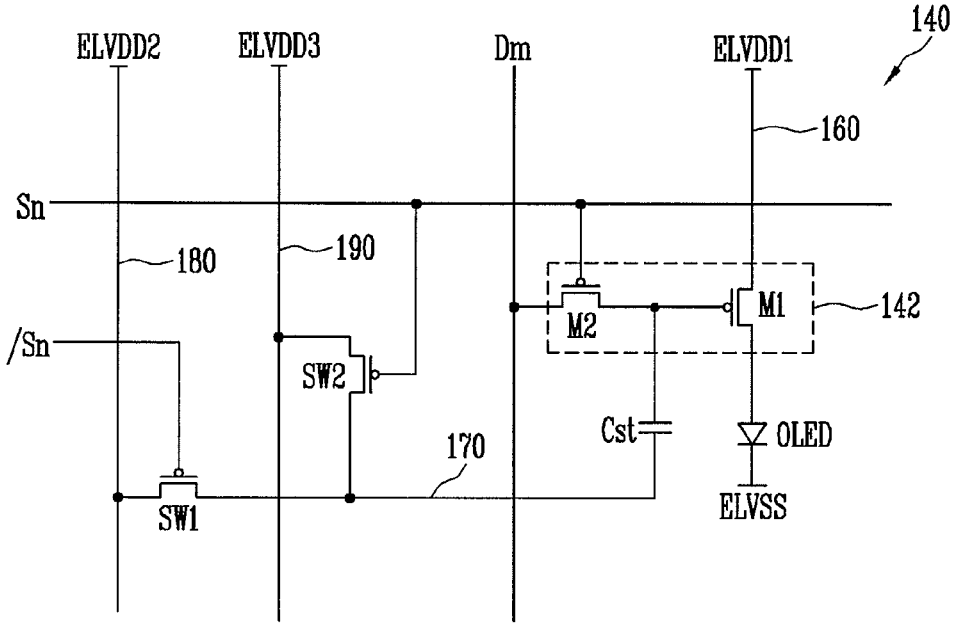
FIG. 2 is a diagram illustrating an embodiment of a pixel shown in FIG. 1.

FIG. 2 is a diagram illustrating an embodiment of a pixel shown in FIG. 1.

Referring to FIG. 2, the pixel 140 according to an embodiment of the present invention includes: an organic light emitting diode OLED, a pixel circuit 142 controlling the amount of current supplied to the organic light emitting diode OLED; and a storage capacitor Cst coupled between the pixel circuit 142 and the fourth power line 170.

The anode electrode of the organic light emitting diode OLED is coupled to the pixel circuit 142 and the cathode electrode is coupled to the fourth power supply ELVSS. The organic light emitting diode OLED produces light with a luminance (e.g., a predetermined luminance) in response to the current supplied from the pixel circuit 142.

The storage capacitor Cst is coupled between the gate electrode of the driving transistor (e.g., a first transistor M1) and the fourth power line 170. The storage capacitor Cst is charged with a voltage corresponding to the data signal supplied from the pixel circuit 142 and the power of the third power supply ELVDD3 which is supplied through the fourth power line 170. Further, after being charged with a voltage (e.g., a predetermined voltage), the storage capacitor Cst controls the gate electrode voltage of the driving transistor in response to the power of the second power supply ELVDD2 which is supplied through the horizontal power line 170.

The pixel circuit 142 controls the amount of current flowing from the first power supply ELVDD1 to the fourth power supply ELVSS through the organic light emitting diode OLED, in response to the voltage from the charged storage capacitor Cst. For this operation, the pixel circuit 142 includes a first transistor M1 and a second transistor M2.

A first electrode of the first transistor M1 is coupled to the first power supply ELVDD1 through the first power line 160, and a second electrode of the first transistor M1 is coupled to the anode electrode of the organic light emitting diode OLED. Further, a gate electrode of the first transistor M1 is coupled to a first terminal of the storage capacitor Cst. The first transistor M1 controls the amount of current supplied to the organic light emitting diode OLED in response to the voltage of the charged storage capacitor Cst.

A first electrode of the second transistor M2 is coupled to the data line Dm and a second electrode of the second transistor M2 is coupled to the gate electrode of the first transistor M1. Further, a gate electrode of the second transistor M2 is coupled to the first scan line Sn. When a scan signal is supplied to the first scan line Sn, the second transistor M2 is turned on and electrically couples the data line Dm with the gate electrode of the first transistor M1.

Figure 3:
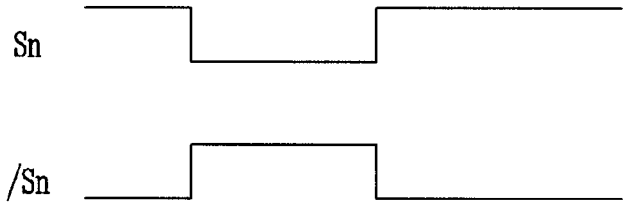
FIG. 3 is a waveform diagram illustrating a method of driving the pixel shown in FIG. 2.

FIG. 3 is a waveform diagram illustrating a method of driving the pixel shown in FIG. 2.

Referring to FIG. 3, a scan signal is supplied to the first scan line Sn, and an inverse scan signal is supplied to the second scan line /Sn.

The first switching element SW1 is turned off when the inverse scan signal is supplied to the second scan line /Sn. The fourth power line 170 and the second power line 180 are electrically disconnected when the first switching element SW1 is turned off.

The second switching element SW2 and the second transistor M2 are turned on when a scan signal is supplied to the first scan line Sn. The fourth power line 170 and the third power line 190 are electrically coupled when the second switching element SW2 is turned on. In this case, the voltage of the third power supply ELVDD3 is supplied to the fourth power line 170.

The data line Dm and the gate electrode of the first transistor M1 are electrically coupled when the second transistor M2 is turned on. Therefore, a data signal from the data line Dm may be supplied to the gate electrode of the first transistor M1. In this operation, the storage capacitor Cst is charged with a voltage corresponding to the difference between the data signal and the third power supply ELVDD3.

After the storage capacitor Cst is charged, the supply of a scan signal to the first scan line Sn is stopped and the supply of an inverse scan signal to the second scan line /Sn is stopped. The second transistor M2 and the second switching element SW2 are turned off when the supply of a scan signal to the first scan line Sn is stopped.

The first switching element SW1 is turned on when the supply of an inverse scan signal to the second scan line /Sn is stopped. The second power line 180 and the fourth power line 170 are electrically coupled when the first switching element SW1 is turned on, and accordingly, the voltage of the second power supply ELVDD2 is supplied to the fourth power line 170.

In this operation, the voltage of the fourth power line 170 rises from the voltage of the third power supply ELVDD3 to the voltage of the second power supply ELVDD2. As the voltage level on the fourth power line 170 rises, the gate electrode voltage level of the first transistor M1 is increased by the storage capacitor Cst. As the gate electrode voltage is increased by the storage capacitor Cst, as described above, an image with desired luminance can be displayed. In other words, the gate electrode of the first transistor M1 increases by as much as the voltage of the data signal that is lost by charge-sharing between a parasitic capacitor of the data line Dm and the storage capacitor Cst. Accordingly, an image with desired luminance can be displayed. In one embodiment, the voltage difference between the second power supply ELVDD2 and the third power supply ELVDD3 is experimentally determined such that the voltage of the data signal lost by the charge-sharing can be compensated for.

After the gate electrode voltage of the first transistor M1 increases, the first transistor M1 controls the amount of current flowing from the first power supply ELVDD1 to the fourth power supply ELVSS through the organic light emitting diode OLED, in response to the voltage applied to the gate electrode thereof.

In an embodiment of the present invention having the above configuration, the voltage of the charged storage capacitor Cst may be determined regardless of the first power supply ELVDD1 supplying current to the organic light emitting diode OLED. In other words, it is possible to charge the storage capacitor Cst by using the third power supply ELVDD3, of which the voltage does not drop, and correspondingly display an image with desired luminance.

Additionally, the storage capacitor Cst may include a MOS capacitor Cst, and accordingly, the manufacturing cost can be reduced.

In one embodiment, the storage capacitor Cst is formed by metallizing a crystalized polysilicon (or poly), and stores a voltage by using the overlap area between the metallized poly and a gate metal (or metal cap). Additionally, the overlap area between the gate metal and the source/drain metal may also be used to increase the capacity. However, this entails using a mask in the manufacturing process in order to crystallize the poly, and accordingly, the manufacturing cost increases.

However, according to an embodiment of the present invention, the storage capacitor Cst is formed using the overlap area between the poly and the gate metal (the overlap area between the gate metal and the source/drain metal may additionally be used to increase the capacity). In this case, the mask for crystallizing the poly may be removed, and the manufacturing cost may be reduced.

In one embodiment, the gate metal of the storage capacitor Cst is a second terminal coupled to the horizontal line 170, and the poly is a first terminal coupled to the gate electrode of the first transistor M1. Further, the voltage level of the second power supply ELVDD2 and the third power supply ELVDD3 is set lower than the voltage level of the data signal to stably charge the storage capacitor Cst.

Figure 4:
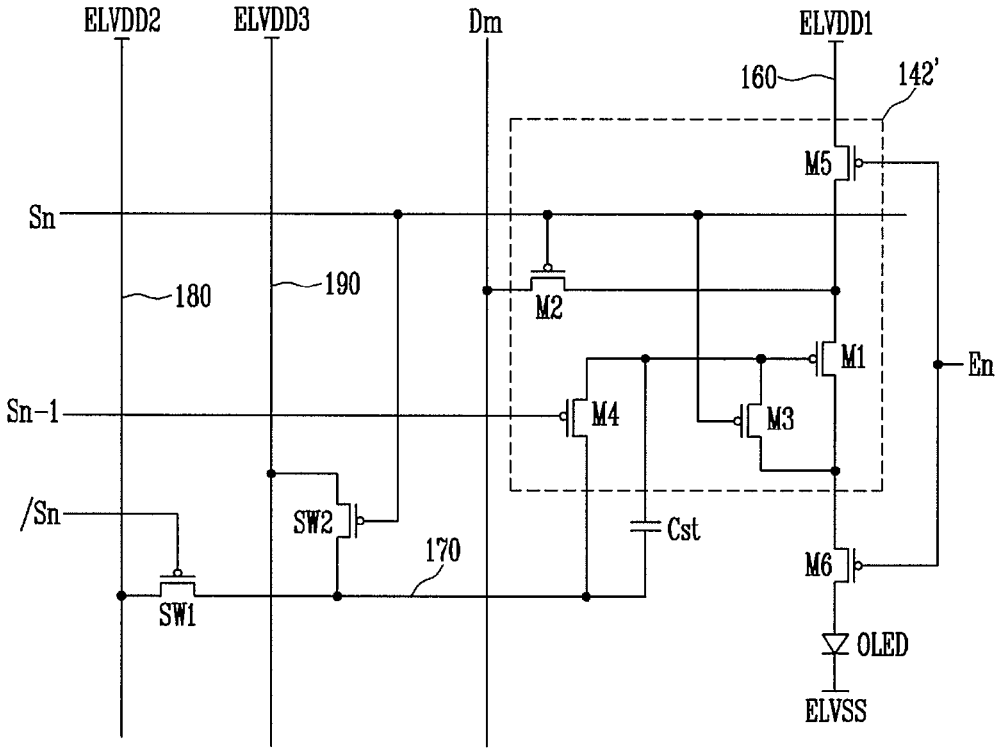
FIG. 4 is a diagram illustrating another embodiment of the pixel shown in FIG. 1.

FIG. 4 is a diagram illustrating another embodiment of the pixel shown in FIG. 2. In explaining FIG. 4, the same components as in FIG. 2 are designated by the same reference numerals and the detailed description is not provided.

Referring to FIG. 4, a pixel according to another embodiment of the present invention includes: an organic light emitting diode OLED; a storage capacitor Cst; and a pixel circuit 142' for controlling the amount of current supplied to the organic light emitting diode OLED in response to the voltage charged in the storage capacitor Cst.

The anode electrode of the organic light emitting diode OLED is coupled to the pixel circuit 142' and the cathode electrode is coupled to a fourth power supply ELVSS. The organic light emitting diode OLED produces light with a luminance (e.g., a predetermined luminance) in response to the current supplied from the pixel circuit 142'.

The storage capacitor Cst may be a MOS capacitor, and may be coupled between the gate electrode of a first transistor M1 and a fourth power line 170 (e.g., a horizontal power line.) In this operation, the storage capacitor Cst is charged with a voltage corresponding to a data signal and a third power supply ELVDD3. Further, the storage capacitor Cst may control a gate electrode voltage of the driving transistor in response to the power of a second power supply ELVDD2 through the horizontal power line 170.

The pixel circuit 142' controls the amount of current flowing from a first power supply ELVDD1 to the fourth power supply ELVSS through the organic light emitting diode OLED in response to the voltage charged in the storage capacitor Cst. For this operation, the pixel circuit 142' includes first to sixth transistors M1 to M6.

A first electrode of the first transistor M1 is coupled to a second electrode of the fifth transistor M5 and a second electrode of the first transistor M1 is coupled to a first electrode of the sixth transistor M6. Further, a gate electrode of the first transistor M1 is coupled to a first terminal of the storage capacitor Cst. The first transistor M1 supplies current corresponding to a voltage level applied to the gate electrode of the first transistor M1 to the organic light emitting diode OLED.

A first electrode of the second transistor M2 is coupled to the data line Dm and a second electrode of the second transistor M2 is coupled to the first electrode of the first transistor M1. Further, a gate electrode of the second transistor M2 is coupled to the n-th first scan line Sn. The second transistor M2 is turned on and electrically couples the data line Dm with the first electrode of the first transistor M1 when a scan signal is supplied to the n-th first scan line Sn.

A first electrode of the third transistor M3 is coupled to a second electrode of the first transistor M1, and a second electrode of the third transistor M3 is coupled to the gate electrode of the first transistor M1. Further, a gate electrode of the third transistor M3 is coupled to the n-th first scan line Sn. The third transistor M3 is turned on and diode-connects the first transistor M1 when a scan signal is supplied to the n-th first scan line Sn.

A first electrode of the fourth transistor M4 is coupled to the gate electrode of the first transistor M1 and a second electrode of the fourth transistor M4 is coupled to the fourth power line 170. Further, a gate electrode of the fourth transistor M4 is coupled to the n−1-th first scan line Sn-1. The fourth transistor M4 is turned on and electrically couples the fourth power line 170 with the gate electrode of the first transistor M1 when a scan signal is supplied to the n−1-th first scan line Sn-1.

A first electrode of the fifth transistor M5 is coupled to the first power supply ELVDD1 through the first power line 160 and a second electrode is coupled to the first electrode of the first transistor M1. Further, the gate electrode of the fifth transistor M5 is coupled to an emission control line En. The fifth transistor M5 is turned off when an emission control signal is supplied to the emission control line En, and turned on during the other period.

A first electrode of the sixth transistor M6 is coupled to a second electrode of the first transistor M1 and a second electrode of the sixth transistor M6 is coupled to the anode electrode of the organic light emitting diode OLED. Further, the gate electrode of the sixth transistor M6 is coupled to the emission control line En. The sixth transistor M6 is turned off when an emission control signal is supplied to the emission control line En, and turned on during the other period.

Figure 6:
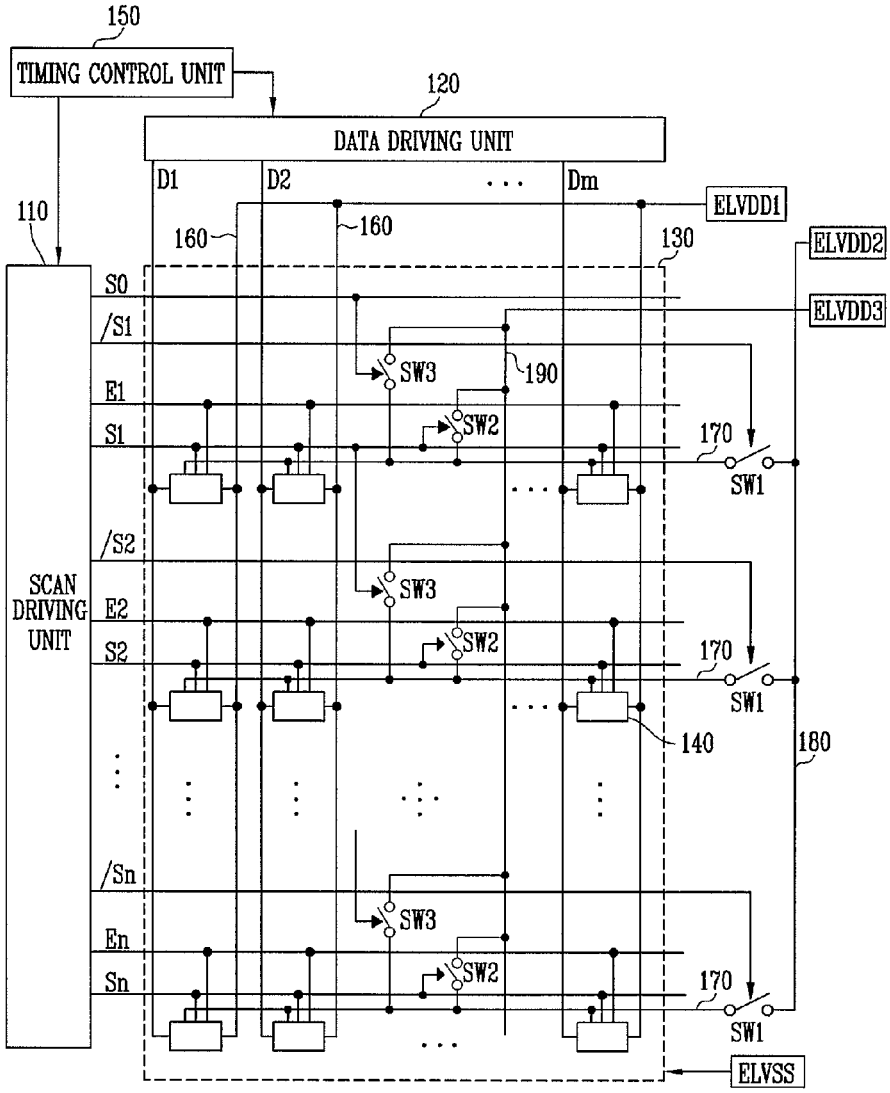
FIG. 6 is a diagram illustrating an organic light emitting display device according to another embodiment of the present invention.

Meanwhile, the emission control lines, as shown in FIG. 6, extend in parallel with the first scan lines S1 to Sn, and extend in each of the horizontal lines (e.g., E1 to En). Further, the emission control signal supplied to the i-th (i is a natural number) emission control line Ei overlaps a scan signal supplied to the i−1-th and i-th scan lines Si-1, Si.

Figure 5:
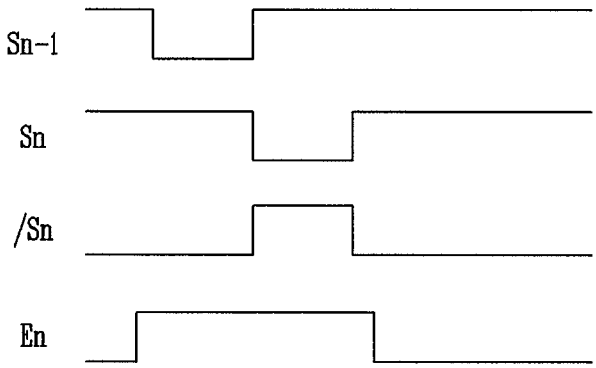
FIG. 5 is a waveform diagram illustrating a method of driving the pixel shown in FIG. 4.

FIG. 5 is a waveform diagram illustrating a method of driving the pixel shown in FIG. 4, according to one embodiment of the present invention.

Referring to FIG. 5, an emission control signal is first supplied to the emission control signal En. As the emission control signal is applied to the emission control line En, the fifth transistor M5 and the sixth transistor M6 are turned off. When the fifth transistor M5 and the sixth transistor M6 are turned off, the first transistor M1 is electrically disconnected from the first power supply ELVDD1 and the organic light emitting diode OLED. Accordingly, the organic light emitting diode OLED is not set to emit light.

Thereafter, a scan signal is supplied to the n−1-th scan line Sn-1 and the fourth transistor M4 is turned on. The gate electrode of the first transistor M1 and the fourth power line 170 are electrically coupled to each other when the fourth transistor M4 is turned on. In this case, the gate electrode of the first transistor M1 is initialized with the voltage of the second power supply ELVDD2 which is supplied to the fourth power line 170.

The second switching element SW2, the second transistor M2, and the third transistor M3 are turned on in response to a scan signal supplied to the n-th first scan line Sn, after the gate electrode of the first transistor M1 is initialized with the voltage of the second power supply ELVDD2. Further, the first switching element SW1 is turned off when an inverse scan signal is supplied to the n-th second scan line /Sn.

The first transistor M1 is diode-connected when the third transistor M3 is turned on.

A data signal from the data line Dm is supplied to the first electrode of the first transistor M1 when the second transistor M2 is turned on. In this operation, the data signal is supplied to the gate electrode of the first transistor M1, because the gate electrode of the first transistor M1 has been initialized with the voltage of the second power supply ELVDD2, which is lower than that of the data signal. In this case, the data signal supplied to the gate electrode of the first transistor M1 is set to the voltage obtained by subtracting the absolute value of the threshold voltage of the first transistor M1 from the voltage of the data signal.

The voltage level of the third power supply ELVDD3 is supplied to the fourth power line 170 when the second switching element SW2 is turned on. In this operation, the storage capacitor Cst is charged with a voltage corresponding to the difference between the data signal applied to the gate electrode of the first transistor M1 and the third power supply ELVDD3.

Thereafter, the supply of a scan signal to the n-th first scan line Sn is stopped, such that the second switching element SW2, the second transistor M2, and the third transistor M3 are turned off. Further, the supply of an inverse scan signal to the n-th second scan signal /Sn is stopped, such that the voltage level of the second power supply ELVDD2 is supplied to the fourth power line 170. In this operation, the storage capacitor Cst raises the gate electrode voltage of the first transistor M1 as much as the voltage difference between the third power supply ELVDD3 and the second power supply ELVDD2.

The supply of an emission control signal to the emission control line En is stopped after the gate electrode voltage of the first transistor M1 is raised. As the supply of an emission control signal to the emission control line En is stopped, the fifth transistor M5 and the sixth transistor M6 are turned on.

The first power supply ELVDD1 and the first electrode of the first transistor M1 are electrically coupled when the fifth transistor M5 is turned on. The anode electrode of the organic light emitting diode OLED and the second electrode of the first transistor M1 are electrically coupled when the sixth transistor M6 is turned on. The first transistor M1 controls the amount of current flowing from a first power supply ELVDD1 to the fourth power supply ELVSS through the organic light emitting diode OLED, in response to the voltage applied to the gate electrode of the first transistor M1.

Meanwhile, although one second switching element SW2 is coupled in each of the horizontal line in FIG. 1, the present invention is not limited thereto. For example, as shown in FIG. 6, a third switching element SW3 coupled between each of the fourth power lines 170 and the third power line 190 may be further provided.

The third switching element SW3 located in the i-th horizontal line is turned on and electrically couples the third power line 190 with the fourth power line 170 when a scan line is supplied to the i−1-th first scan line Si-1. The gate electrode of the first transistor M1 is initialized by the voltage of the third power supply ELVDD3 when this configuration is applied to the pixel 140 shown in FIG. 4.

While the present invention has been described in connection with certain exemplary embodiments, it is to be understood that the invention is not limited to the disclosed embodiments, but, on the contrary, is intended to cover various modifications and equivalent arrangements included within the spirit and scope of the appended claims, and equivalents thereof.

What is claimed is:

1. An organic light emitting display device comprising;

a scan driver for sequentially supplying scan signals to first scan lines and sequentially supplying inverse scan signals that are produced by inverting the scan signals, to second scan lines;

a data driver for supplying data signals to data lines;

a display unit comprising pixels located at crossing regions of the first scan lines and the data lines, each of the pixels comprising a storage capacitor;

first power lines extending in parallel to the data lines and coupled between a first power supply and the pixels;

at least one second power line located outside the display unit and coupled to a second power supply having a voltage different from a voltage of the first power supply;

at least one third power line extending in parallel with the data lines and coupled to a third power supply having a voltage different from the voltage of the first power supply; and fourth power lines extending in the pixels are charged with voltages corresponding to the data signals and the third in parallel with the scan lines and coupled to the pixels, wherein the storage capacitors power supply and are configured to control an amount of current flowing from the first power supply in accordance with the voltages charged in the pixels, and wherein one terminal of the storage capacitors is configured to receive a voltage from the second power supply in response to the scan signals, and to receive a voltage from the third power supply in response to the inverse scan signals.

2. The organic light emitting display device as claimed in claim 1, wherein the second power supply is configured to supply a higher voltage than the third power supply.

3. The organic light emitting display device as claimed in claim 1, wherein the second power supply and the third power supply are configured to supply the voltages that are lower than the data signals.

4. The organic light emitting display device as claimed in claim 1, further comprising:

first switching elements respectively coupled between the fourth power lines and the at least one second power line; and second switching elements respectively coupled between the fourth power lines and the at least one third power line.

5. The organic light emitting display device as claimed in claim 4, wherein the first switching elements and the second switching elements are alternately turned on and off.

6. The organic light emitting display device as claimed in claim 5, wherein one of the first switching elements that is coupled to an i-th fourth power line of the fourth power lines is turned on when one of the scan signals is supplied to an i-th first scan line of the first scan lines, and one of the second switching elements that is coupled to the i-th fourth power line is turned off when one of the inverse scan signals is supplied to an i-th second scan line of the second scan lines, and the one of the second switching elements that is coupled to the i-th fourth power line is turned on when the one of the inverse scan signals is not supplied to the i-th second scan line.

7. The organic light emitting display device as claimed in claim 4, further comprising third switching elements respectively coupled between the fourth power lines and the at least one third power line.

8. The organic light emitting display device as claimed in claim 7, wherein one of the third switching elements that is coupled to an i-th fourth power line of the fourth power lines is turned on when one of the scan signals is supplied to an i−1-th first scan line of the first scan lines.

9. The organic light emitting display device as claimed in claim 1, wherein one of the scan signals that is supplied to an i-th first scan line of the first scan lines is supplied at substantially a same time and for substantially a same duration as one of the inverse scan signals that is supplied to an i-th second scan line of the second scan lines, and wherein the scan signals and the inverse scan signals have opposite polarities.

10. The organic light emitting display device as claimed in claim 9, wherein each of the pixels coupled to an i-th fourth power line of the fourth power lines comprises:

an organic light emitting diode;

a first transistor coupled between the organic light emitting diode and a corresponding one of the first power lines; and a second transistor coupled between a gate electrode of the first transistor and a corresponding one of the data lines, and the second transistor is turned on when one of the scan signals is supplied to the i-th first scan line, wherein the storage capacitor is coupled between the gate electrode of the first transistor and the i-th fourth power line.

11. The organic light emitting display device as claimed in claim 9, further comprising emission control lines extending in parallel with the first scan lines.

12. The organic light emitting display device as claimed in claim 11, wherein the scan driver is configured to supply an emission control signal to an i-th emission control line of the emission control lines that overlaps with one of the scan signals supplied to an i−1-th first scan line of the first scan lines and one of the scan signals supplied to the i-th first scan line of the first scan lines.

13. The organic light emitting display device as claimed in claim 12, wherein each of the pixels coupled to an i-th fourth power line of the fourth power lines comprises:

an organic light emitting diode;

a first transistor having a first electrode coupled to a corresponding one of the first power lines, and a second electrode coupled to the organic light emitting diode;

a second transistor coupled between a corresponding one of the data lines and the first electrode of the first transistor, the second transistor being configured to turn on when the one of the scan signals is supplied to the i-th first scan line;

a third transistor coupled between a gate electrode and the second electrode of the first transistor, the third transistor being configured to turn on when the one of the scan signals is supplied to the i-th first scan line;

a fourth transistor coupled between the gate electrode of the first transistor and a corresponding one of the fourth power lines, the fourth transistor being configured to turn on when a corresponding one of the scan signals is supplied to an i−1-th first scan line of the scan lines; and a storage capacitor coupled between the gate electrode of the first transistor and the corresponding one of the fourth power lines.

14. The organic light emitting display device as claimed in claim 13, further comprising:

a fifth transistor coupled between the first electrode of the first transistor and the corresponding one the first power lines, the fifth transistor being configured to turn off when the emission control signal is supplied to the i-th emission control line; and a sixth transistor coupled between the second electrode of the first transistor and the organic light emitting diode, the sixth transistor being configured to turn off when the emission control signal is supplied to the i-th emission control line.

* * * * *